United States Patent [19]

Eiserlo et al.

[11] Patent Number: 4,854,948

[45] Date of Patent: Aug. 8, 1989

[54] SUPPLY CIRCUIT FOR ELECTROSTATIC DUST SEPARATOR

[75] Inventors: Friedrich Eiserlo; Kurt Emmrich, both of Tönisvorst, Fed. Rep. of Germany

[73] Assignee: Walther & Cie. Aktiengesellschaft, Cologne, Fed. Rep. of Germany

[21] Appl. No.: 140,913

[22] Filed: Dec. 30, 1987

Related U.S. Application Data

[63] Continuation of Ser. No. 825,771, Feb. 3, 1986, abandoned.

[30] Foreign Application Priority Data

Nov. 6, 1982 [DE] Fed. Rep. of Germany ..... 3241060

[51] Int. Cl.[4] ..... B03C 3/66

[52] U.S. Cl. ..... 55/105; 55/139; 323/903

[58] Field of Search ..... 55/105, 139; 323/239, 323/240, 246, 251, 903; 336/213, 229

[56] References Cited

U.S. PATENT DOCUMENTS

| | | | |
|---|---|---|---|
| 2,085,060 | 6/1937 | Young | 323/246 X |
| 3,064,219 | 11/1962 | Gabor | 336/214 X |
| 3,346,802 | 10/1967 | Biet | 323/240 |
| 3,602,805 | 8/1971 | Vukasovic | 323/903 X |
| 3,873,282 | 3/1975 | Finch | 55/105 |
| 3,877,896 | 4/1975 | Muskovac | 55/105 |
| 3,996,543 | 12/1976 | Conner et al. | 336/213 X |
| 4,116,728 | 9/1978 | Becker et al. | 336/213 X |
| 4,138,232 | 2/1979 | Winkler et al. | 55/105 |
| 4,233,039 | 11/1980 | Schmidt | 55/139 |
| 4,336,520 | 12/1982 | Finke et al. | 336/213 X |
| 4,413,225 | 11/1983 | Donig et al. | 323/903 X |
| 4,432,061 | 2/1984 | Herklotz et al. | 55/105 X |

OTHER PUBLICATIONS

Lamson, H. W., "Advantages of Toroidal Transformers", *Tele-Tech,* May, 1950, pp. 32-34.

*Primary Examiner*—Bernard Nozick

*Attorney, Agent, or Firm*—Spensley Horn Jubas & Lubitz

[57] ABSTRACT

The pulse voltage for the electrode (12) of a dust separator (10) is generated by a thyristor circuit (19) to be transferred to a dust separator through a transformer (16). It being possible that voltage arcings take place at the dust separator (10), there is the risk, in case of a blocked thyristor (20) that from the secondary of the transformer (16) a high voltage is produced at thyristor (20) to destroy the thyristor. To avoid such an occurrence, a detector (27) is provided which is only responsive to sudden voltage drops whereupon the thyristor (20) is enabled to become conductive so that the energy of the secondary circuit may be discharged to the storage capacitor (24) in the primary circuit.

9 Claims, 2 Drawing Sheets

SUPPLY CIRCUIT FOR ELECTROSTATIC DUST SEPARATOR

Figure 1:
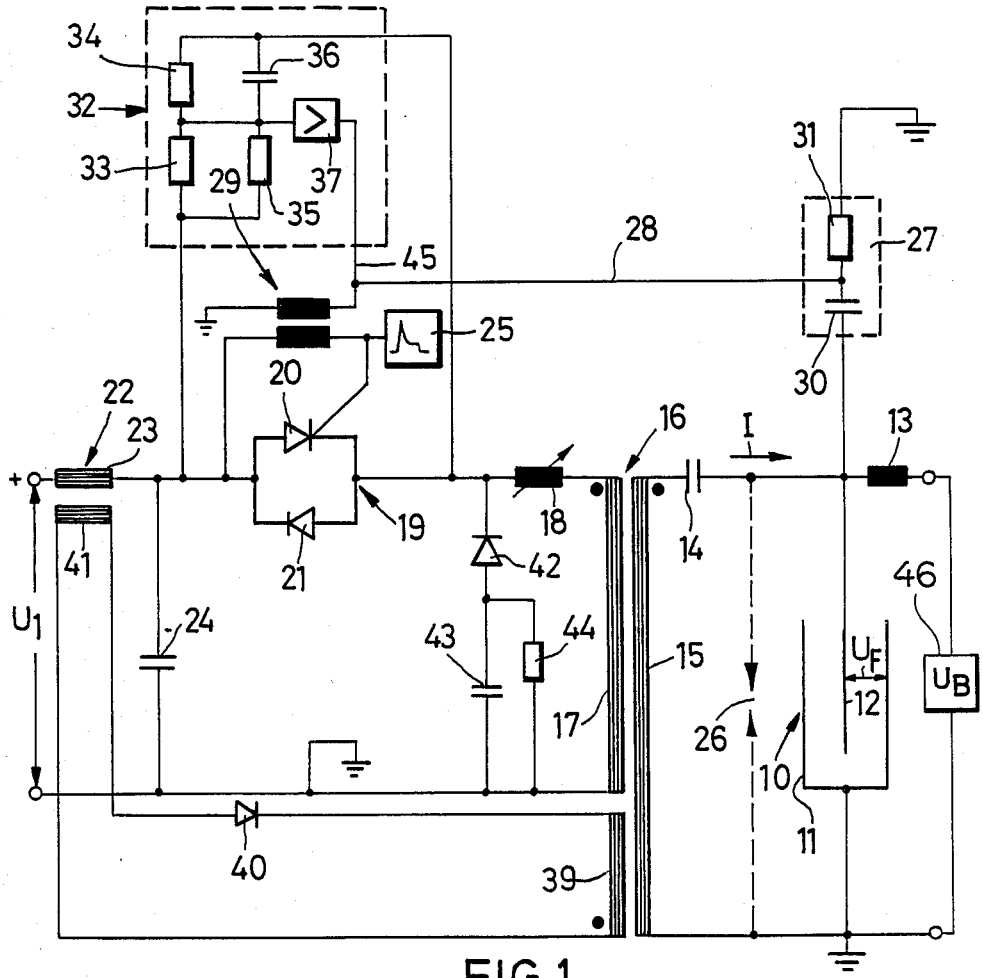

This is a continuation of application Ser. No. 825,771, filed on Feb. 3, 1986, now abandoned.

The invention relates to a supply circuit for an electrostatic dust separator comprising a transformer having a primary circuit that contains a pulse-controlled thyristor circuit and having a secondary circuit which contains a series-connection comprising the dust separator and a capacitor.

Two factors are required for the electrostatic cleaning of gas to remove dust, viz. charge carriers, on the one hand, which, due to a corona under high voltage action, are emitted from the discharge electrode of the separator to become attached to the dust particles which are carried off in the gas, and a high voltage field, on the other hand, in which, according to the Coulomb's law, the charged particles are exposed to a force effect driving them towards the positive anode. Said force exerted on the particles in the high voltage field is proportional to the intensity of the electric field and to the level of the applied voltage, i.e. the quicker the motion of the particles, the smaller the possible design of the filter. With this in mind, tests were made to keep the voltage as high as possible. However, as a resultant disadvantage, a very high surplus of charge carriers is produced with some dusts, in particular with highly insulating dusts, and in critical cases, this may result in a backdischarge. Both said functions, i.e. the generating of charge carriers and availability of a high voltage are separated with the pulse-type energy supply. A short voltage pulse above the disruptive voltage shall generate explosively for a short time charge carriers while a second device generates a so-called base voltage being as even as possible and only serving to accelerate the charge of the loaded dust particles. Said base voltage should be as close as possible to the glow discharge voltage point so as to avoid a surplus of charge carriers. To permit to positively introduce pulses of a high power density into the filter, they should be supplied for a period as short as possible, i.e. in the order between 40 and 200 μs. Due to the short time, the provided voltage of said pulses may be very high above the normal disruptive voltage, because by the delayed rising of the channel discharge resulting in an electric arc there is again time for the voltage to decrease, so that for lack of energy, no supply to the discharge channel will take place.

The known circuit disclosed by Federal Republic of Germany Patent application No. 2608436 substantially consists of a separator capacitor and a thyristor circuit by which energy is transferred from a storage capacitor to the separator capacitor. As a result of the stray inductivities contained in each circuit and of a resistance, energy is transferred from the storage capacitor to the separator capacitor in the form of an attenuated oscillation. An oscillating circuit formed by the inductivity of the transformer, the capacity of the dust separator and a coupling capacitor is responsible for the backfeeding of the energy stored in the separator during the pulse of the voltage source. The back-oscillating energy is recycled to the storage capacitor by a diode in antiparallel connection to the thyristor, thus only requiring the replacement of losses in the circuit and of the spattered current.

Thyristors for a short-time connection of high voltages and high powers are very expensive. Very often, in case of electrofilters, a spark-over is taking place during a voltage pulse when very high voltages are applied for a short period to generate the required charge carriers. The voltage at the electrode of the dust separator suddenly breaks down because, in a way, the dust separator is short-circuited. An oscillating circuit formed by said short-circuit now only still consists of the transformer and the coupling capacitor. The oscillation which is transferred to the primary side of of the transformer is producing there a high current tending to load the charging capacitor. If the thyristor circuit is in the conductive state, the current may freely flow to the storage capacitor. However, if the thyristor circuit is already blocked, the formed voltage peak may cause the destruction of the thyristors and of the diodes in antiparallel connection.

It is the object of the invention to provide a supply circuit of the above mentioned type which can be operated with short-time pulses of a high voltage to obtain an effective generation of charge carriers without the risk of destroying the thyristors or other electronic elements.

To solve the posed problem, the electrode of the dust separator of the invention is coupled with a detector which is only responsive to quick voltage variations which may occur with a spark-over at the dust separator whereupon the thyristor circuit is rendered conductive.

In case of a sudden voltage breakdown by spark-over with a conductive thyristor circuit, the oscillating current transferred from the secondary of the transformer to the primary may flow to the charging capacitor. On the other hand, in case of a blocked thyristor circuit, the voltage forming there would become as high as to possibly destroy the thyristors. Such a high voltage development will be inhibited by the detector which is not responsive to the normal pulse transfer to the electrode of the dust separator, but to a sudden voltage breakdown, whereupon the thyristor circuit is immediately rendered conductive. Thus, by the action of the detector, the thyristors are effectively protected against overvoltage and destruction.

In blocked condition, the thyristors may be endangered as well by other voltage influences either via the transformer or via the voltage supply. In case of such overvoltages which may slowly develop and which are not detected by the detector, the thyristors are endangered. To avoid such risks, an advantageous embodiment of the invention provides a protective circuit which taps the potentials upstream and downstream of the thyristor circuit the latter being rendered conductive if the potential difference exceeds a predetermined value. Said protective circuit is directly responsive to the voltage between the main electrodes of the thyristors. Its reaction time must be extremely short, e.g. 1 μs, to render the thyristors conductive before the blocked thyristors will suffer from voltage breakdowns.

It is important for the production of a sufficient quantity of free charge carriers during the high voltage pulses at the dust separator that the voltage of the high voltage pulses is high, on the one hand, while the pulses should be short, on the other hand, to avoid spark-over voltages. However, short high voltage pulses can be only realised in case of a stray inductivity of the transformer as low as possible. The usual transformers contain an iron core of sheets piled abreast. They do not form a continuous magnetic path, but they contain reflection points which may cause magnetic losses and leakages. According to another aspect of the invention, short-time and sharply limited voltage pulses are obtained by a transformer whose annular core as a winding carrier is made of a spirally wound sheet. The resultant magnetic path is continuous and free of points of reflection. Its stray inductivity is reduced to a minimum. Short high voltage pulses may be generated in the secondary with such a toroidal transformer. Due to the short pulse time, the voltage produced may be higher than with the known transformers without increasing the risk of spark-over voltages at the dust separator.

Another problem inherent to the production of high pulse voltages with a transformer resides in the fact that with each pulse the transformer core is magnetized in the same direction. There is left in the core by each pulse a residual magnetization or remanence on which the new magnetization is built up in the same direction. After a few pulses, the magnetization of the core is saturated and the amplitudes of the pulses generated in the secondary become smaller and smaller. To avoid this effect, it is provided that the transformer contains in addition to the secondary winding and the primary winding an auxiliary winding which is traversed by a rectified countermagnetizing current which produces a magnetic field being opposite to that of the pulse current by the primary current. The countermagnetizing current is a DC current which, after each transferred pulse ensures that the iron of the transformer is remagnetized to the working point.

Preferably, the countermagnetizing current is generated by the secondary coil of an auxiliary transformer whose primary coil is placed in series with the thyristor circuit. Thus, the magnitude of the demagnetizing direct current produced is dictated by the magnitude or frequency of the pulse current so that backmagnetization will be limited to the required extent. If pulses having a higher frequency are generated, the countermagnetizing current formed is higher than in case of pulses having a lower frequency.

With reference to the drawings, one embodiment of the invention will be explained hereinafter in more details.

Figure 2:
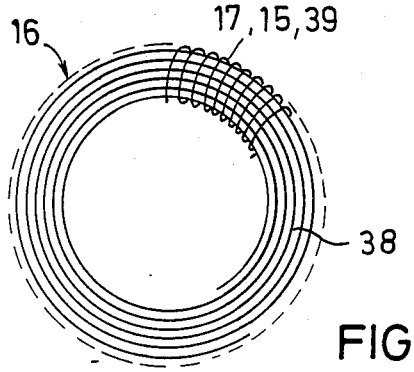
Figure 3:
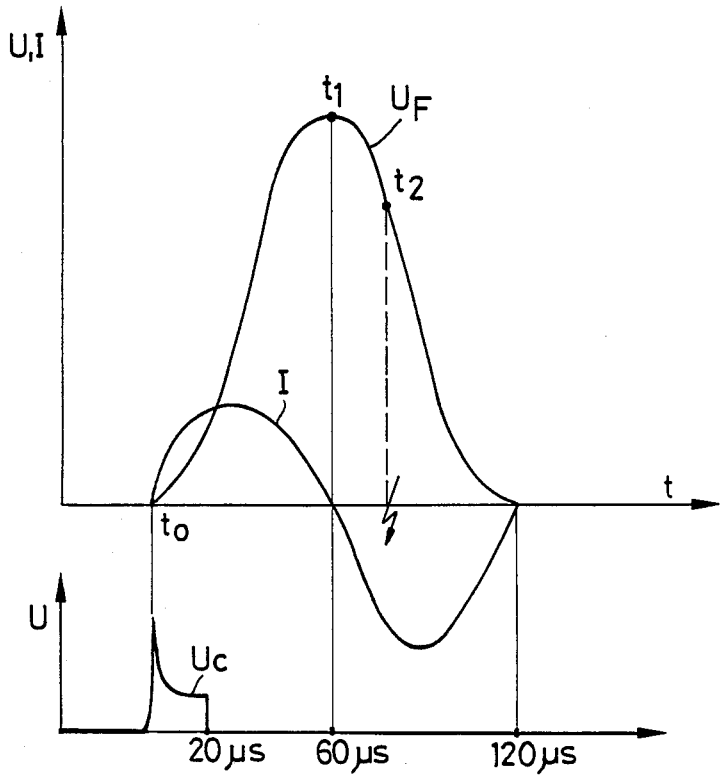

FIG. 1 is a schematic wiring diagram of the supply circuit for the dust separator, FIG. 2 is a schematic view of the toroidal transformer, FIG. 3 is a current-voltage diagram of the pulses in which voltage U and current I are plotted as a function of time t.

According to FIG. 1, the casing 11 of a dust separator 10 is connected to the earth potential. An electrode 12 projecting into the cup-shaped casing 11 is used to produce a high voltage against the casing 11. The voltage between the electrode 12 and the casing 11 is designated with $U_F$.

Through a choke coil 13 a base voltage $U_B$ of e.g. 35 kV is applied to the electrode 12. Said base voltage is a direct voltage being supplied by a voltage source 46.

Through a coupling capacitor 14 of 1 $\mu$F, the electrode 12 is connected to the one end of the secondary winding 15 of the transformer 16, while the other end of the secondary winding 15 is connected to the earth potential.

One end of the primary winding 17 of the transformer 16 is also connected to the earth potential. Its other end is connected through a coil 18 providing an adjustable inductivity to the thyristor circuit 19 which consists of several pairs in parallel connection consisting each of a thyristor 20 and of a diode 21 in antiparallel connection with the thyristor 20. For a better survey, only one of said pairs is shown. Through the primary winding 23 of an auxiliary transformer 22 the thyristor circuit 19 is connected to the positive pole of the supply voltage $U_1$ which has an output of e.g. 7 kV. A storage capacitor 24 is connected at one lead between the primary winding 23 and the thyristor circuit 19, while the other lead is connected to the earth potential.

The diagram disclosed above has been known. In operation, its storage capacitor 24 is charged to the voltage $U_1$. If, by applying a short-time pulse from a control device 25 to the control terminal of the thyristor 20, the latter is rendered conductive, a current is flowing through the coil 18 to traverse the primary winding 17. The current induces a high voltage in the secondary winding 15. The winding ratio of primary winding 17 to secondary winding 15 is, for instance, 1:7. A series of oscillatory circuit is formed by the secondary winding 15 with the capacitor 14 and the capacity of the dust separator 10. At the latter the voltage curve $U_F$ as shown in FIG. 3 is formed which nearly exactly performs the function of a sine curve. The maximum voltage of $U_F$ is about 60 kV, and this pulse is heterodyning with the base voltage $U_B$. FIG. 3 also illustrates the course of the current flowing in the series oscillatory circuit. As evident, the current I first traverses a positive semiwave. At the moment at which the voltage $U_F$ has reached its maximum value, current I is passing zero, and during the decrease of voltage $U_F$, a negative semiwave of current I will follow subsequently.

FIG. 3 additionally shows the control voltage $U_C$, i.e. the pulse generated by the control circuit 25 to control the thyristor 20. First off, control voltage $U_c$ has a short voltage peak to enable the thyristor 20; a range of low voltage will follow thereafter. The total time of the control voltage $U_C$ is about 20 $\mu$s, and that of voltage $U_F$ is about 120 $\mu$s. The times stated in FIG. 3 are calculated from the moment $t_o$ at which the enabling of thyristor 20 is started.

At the dust separator 10, spark-over voltages from electrode 12 to the casing 11 may occur as symbolised by the dotted spark path 26. In case of a spark-over, the voltage $U_F$ suddenly drops to zero. If so, the secondary oscillatory circuit of the transformer 16 only consists of secondary winding 15 and capacitor 14. Although voltage $U_F$ has become zero, a high current is flowing via the spark path 26, said current generating a voltage at the primary winding 17 which, through coil 18 and thyristor circuit 19 is discharged to the storage capacitor 24 being recharged accordingly. This does not involve any risk, if the thyristor 20 is still conductive. If it is already blocked, a critically high voltage is generated by the short-circuit of the spark path 26.

At the moment $t_1$ (FIG. 3) at which the voltage $U_F$ has reached the maximum value and current I of the oscillatory circuit is traversing zero, the thyristor 20 is still open, although the control voltage $U_C$ is already terminated. As known, a thyristor is only blocked when the thyristor current traverses zero. If a voltage arcing at the dust separator 10 occurs between times $t_o$ and $t_1$, thyristor 20 conductive up to that moment will remain conductive because upon the arcing voltage for recharging the storage capacitor 24, the direction of the current flowing therethrough is the same as during the positive semiwave of the pulse current. If, on the other hand, the voltage arcing occurs after the moment $t_1$, e.g. at the moment $t_2$, the thyristor 20 is already in a blocked state, a voltage being formed at it which is antipolar to the diode 21 and cannot flow off via said diode.

To avoid a destruction of the thyristor 20 in this condition, a detector 27 connected to the electrode 12, supplies via line 28 in case of a steep drop of voltage $U_F$ a pulse to a transformer 29. The secondary winding of the transformer 29 is connected between the anode terminal and the control terminal of the thyristor 20. The pulse of line 28 transmitted to the secondary coil of the transformer 29 enables the thyristor 20 to become conductive thus ensuring that the high primary-side voltage formed by the secondary-side short-circuit of the transformer 16 is discharged through the conductive thyristor 20 on the storage capacitor 24.

The detector 27 consists of a series-circuit of a capacitor 30 and of a resistor 31 connected to the earth potential. The RC-constant of the detector 27 is about 1 μs, so that a signal at line 28 can be only generated by short-time variations of the voltage $U_F$, while the normal pulse voltage as shown in FIG. 3 does not cause any signal change at line 28.

An additional protective circuit 32 provided for the protection of the thyristor 20 produces a control signal at line 45 responsive to the voltage existing between the main electrodes of the thyristor 20. Said protective circuit comprises a first voltage divider of the resistors 33 and 34 and a second voltage divider of the resistor 35 and capacitor 36. The taps of both voltage dividers are interconnected and joined to the input of an amplifier 37, the output of which is connected to the transformer 29 through line 45. Due to the capacities or inductivities necessarily inherent to the resistors, the reaction time of the ohmic voltage dividers 33,33 is too long. Therefore, the voltage divider 35,36 having a short reaction time due to capacitor 36 is provided in parallel to the ohmic voltage divider.

The constructional design of transformer 16 is shown schematically in FIG. 2. It contains an annular core 38 made of a spirally wound sole sheet metal strip. A primary winding 17 and a secondary winding 15 are wound about the cylindrical annular core in the shown manner. Said core 38 additionally includes an auxiliary winding 39 which is wound oppositely to the primary winding 17 such as dotted in FIG. 1. Via a rectifier 40, the auxiliary winding 39 is connected to both ends of the secondary coil 41 of the auxiliary transformer 22.

Current is flowing through the primary winding 23 of the auxiliary transformer 22 during the pulses which are generated while controlled by the control device 25 of the thyristor 20. A voltage produced in the secondary winding 41 is rectified by rectifier 40 and discharged via the auxiliary winding 39. By this means, a direct current is produced in the auxiliary winding 39. The magnitude of the current is dictated by the frequency and intensity of the pulses at the dust separator 10, and in the core 38, a countermagnetization is caused that inhibits the stepwise saturation of the core 38. A (non-illustrated) capacitor may be provided in parallel to the auxiliary winding 39.

For the additional protection of thyristor 20, a series-connection consisting of a diode 42 and of a capacitor 43 may be connected between the thyristor and the earth potential. A resistor 44 is connected in parallel to the capacitor 43. Due to the diode 42, negative pulse bounces are kept off the cathode terminal of the thyristor 20. Such negative pulse bounces are charging through the diode 42 the capacitor 43 which may be slowly discharged subsequently via the resistor 44. This protective circuit contributes to avoiding sudden overvoltages at the thyristor.

What is claimed is:

1. In an electrostatic dust separator having an electrically conductive casing and an electrode within and spaced from said casing, and having a power supply circuit for producing high voltage pulses including a transformer with primary and secondary windings, said power supply circuit having a primary circuit that includes the primary winding and contains a pulse-controlled thyristor circuit including a control device for enabling the thyristor circuit to become conductive and having a secondary circuit that includes the secondary winding and contains a series connection including a first capacitor and the dust separator casing and electrode, and means for applying a DC voltage across the dust separator casing and electrode, wherein the dust separator is subject to spark-over between said casing and said electrode, which results in inducing a current pulse into said primary circuit from discharge of said first capacitor and which results in an oscillatory circuit consisting of the secondary winding and first capacitor, the improvement comprising:

a detector coupled to the electrode of the dust separator and to said control device, said detector being responsive only to rapid voltage variations occurring with a spark-over at the dust separator and thereupon enabling said control device to cause the thyristor circuit to become conductive, the response time of the detector being substantially less than the cycle duration of said oscillatory circuit; and a second capacitor connected across the primary winding of said transformer via said thyristor circuit for absorbing the current pulse induced in the primary circuit following said spark-over.

2. An electrostatic dust separator according to claim 1, said dust separator power supply circuit including a protective circuit coupled to the pulse-controlled thyristor circuit so that the protective circuit taps the potentials upstream and downstream of the pulse-controlled thyristor circuit, said protective circuit enabling the pulse-controlled thyristor circuit to become conductive if the potential difference exceeds a predetermined value.

3. An electrostatic dust separator according to claim 1 wherein:

said transformer is a toroidal transformer whose core bearing the windings is made of a spirally wound sheet metal and thereby having low stray inductance so that high voltage pulses of short duration will be efficiently transferred between said primary and said secondary circuits.

4. An electrostatic dust separator according to claim 1 wherein:

said transformer has an annular core consisting of a spirally wound sheet so that the transformer has low stray inductance and thereby efficiently generates the high voltage pulses.

5. An electrostatic dust separator according to claim 1 further comprising:

countermagnetizing means for generating a magnetic field in said transformer that is directed opposite to that generated by the primary winding of said transformer.

6. An electrostatic dust separator according to claim 5 wherein the countermagnetizing means comprises an auxiliary circuit having an auxiliary winding on said transformer and an auxiliary transformer supplying power to said auxiliary winding.

7. An electrostatic dust separator having a casing and an electrode across which high voltage pulses are applied to charge dust particles within said separator, and having a DC potential source connected directly across said casing and said electrode to apply a separate DC potential to electrostatically attract the charged dust particles, the improvement wherein:

said pulses are applied to said electrode by a power supply including a transformer having a secondary winding connected across said electrode and casing via a first capacitor, said power supply also including a primary winding of said transformer and primary winding circuit including a pulse-controlled thyristor circuit and a second capacitor connected in series across said primary winding, said primary winding circuit generating said high voltage pulses via said transformer; and detector means coupled to said electrode for detecting a sparkover thereat and, in response to such detection of a sparkover condition, for turning on the pulse-controlled thyristor circuit so that the current pulse resulting from discharge of said first capacitor via said sparkover and transformer secondary winding, which current pulse will be induced into said primary winding, will be "absorbed" in the primary winding circuit by charging the second capacitor via a current path including said turned-on pulse-controlled thyristor circuit, said detector means responding to a sparkover condition in substantially less time that the cycle time of said sparkover current pulse.

8. In an electrostatic dust separator having an electrically conductive casing and an electrode within and spaced from said casing, and having a power supply circuit for producing high voltage pulses including a transformer with primary and secondary windings, said power supply circuit having a primary circuit that includes the primary winding and contains a pulse-controlled thyristor circuit including a control device for enabling the thyristor circuit to become conductive and having a secondary circuit that includes the secondary winding and contains a series connection including a first capacitor and the dust separator casing and electrode, and means for applying a DC voltage across the dust separator casing and electrode, wherein the dust separator is subject to spark-over between said casing and said electrode, said spark-over creating an oscillatory circuit consisting of the secondary winding and first capacitor, and inducing a current pulse into said primary circuit from discharge of said first capacitor, the improvement comprising:

a detector coupled to the electrode of the dust separator and to said control device, said detector being responsive only to rapid voltage variations occurring with a spark-over at the dust separator and thereupon enabling said control device to cause the thyristor circuit to become conductive, said detector responding to rapid voltage variations in substantially less time than the cycle time of said oscillatory circuit;

a second capacitor connected across the primary winding of said transformer via said thyristor circuit for absorbing the current pulse induced in the primary circuit following said spark-over; and a second transformer having a primary coil and a secondary coil, said second transformer being coupled to said primary circuit so that the primary coil of said second transformer is connected in series with said pulse-controlled thyristor circuit; and wherein said primary circuit also has an auxiliary winding, said auxiliary winding being coupled to the secondary coil of said second transformer and being traversed by a rectified countermagnetizing current generated by said second transformer so that a magnetic field is generated which is directed oppositely to that generated by the current provided to the primary circuit of said transformer by said pulse-controlled thyristor circuit.

9. An electrostatic dust separator for removing dust particles from air, comprising:

an electrically conductive casing and an electrode within and spaced from said casing;

a power supply circuit for producing high voltage pulses including a transformer with primary and secondary windings, said power supply circuit having a primary circuit that includes the primary winding and a secondary circuit that includes the secondary winding, and having a first capacitor that is connected in series with the dust separator casing and electrode;

a pulse-controlled thyristor circuit including a control device for enabling the thyristor circuit to become conductive;

means for applying a DC voltage across the dust separator casing and electrode;

a detector comprising a series circuit of a capacitor and a resistor coupled to the electrode of the dust separator and to said control device, said detector being responsive only to rapid voltage variations occurring with a spark-over at the dust separator and thereupon enabling said control device to cause the thyristor circuit to become conductive and having an RC time constant of approximately one microsecond;

a second capacitor connected across the primary winding of said transformer via said thyristor circuit for absorbing the current pulse induced in the primary circuit following said spark-over; and a protective circuit coupled to the pulse-controlled thyristor circuit so that the protective circuit taps the potentials upstream and downstream of the pulse-controlled thyristor circuit, said protective circuit enabling the pulse-controlled thyristor circuit to become conductive if the potential difference exceeds a predetermined value.

* * * * *